US006854503B2

(12) United States Patent
Cross et al.

(10) Patent No.: US 6,854,503 B2
(45) Date of Patent: Feb. 15, 2005

(54) SEMI-CORDLESS UNBALANCED SPRING DRIVEN BLIND SYSTEM AND METHODS FOR ADJUSTING AND MAKING SAME

(75) Inventors: David Cross, Westport, CT (US); Joseph W. Zakowski, New Canaan, CT (US); Martin Balta, Milford, CT (US); Amnouy Athitang, Bridgeport, CT (US); Raymond B. Churchill, Jr., Springfield, NJ (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 10/393,792

(22) Filed: Mar. 20, 2003

(65) Prior Publication Data

US 2003/0221799 A1 Dec. 4, 2003

Related U.S. Application Data

(60) Provisional application No. 60/366,502, filed on Mar. 20, 2002, and provisional application No. 60/366,501, filed on Mar. 20, 2002.

(51) Int. Cl.[7] ..... E06B 9/30

(52) U.S. Cl. ..... 160/168.1 R; 160/173 R; 160/178.1 R

(58) Field of Search ..... 160/168.1 R, 170 R, 160/173 R, 177 R, 178.1 R

(56) References Cited

U.S. PATENT DOCUMENTS

| | | | | | |
|---|---|---|---|---|---|
| 2,266,160 | A | | 12/1941 | Burns | |
| 2,301,485 | A | | 11/1942 | Walker | |
| 2,520,629 | A | | 8/1950 | Esposito | |
| 4,513,805 | A | * | 4/1985 | Mase | 160/299 |
| 5,184,660 | A | * | 2/1993 | Jelic | 160/171 |
| 5,465,775 | A | * | 11/1995 | Biba et al. | 160/168.1 R |
| 5,566,741 | A | * | 10/1996 | Ogawara et al. | 160/297 |
| 6,112,800 | A | * | 9/2000 | Marusak | 160/298 |
| 6,155,328 | A | * | 12/2000 | Welfonder | 160/313 |
| 6,223,802 | B1 | | 5/2001 | Colson | |
| 6,283,192 | B1 | * | 9/2001 | Toti | 160/170 |
| 6,293,329 | B1 | * | 9/2001 | Toti | 160/168.1 R |
| 6,684,930 | B2 | * | 2/2004 | Palmer et al. | 160/170 |
| 6,700,246 | B1 | * | 3/2004 | Bruhn | 310/77 |
| 2004/0007333 | A1 | * | 1/2004 | Militello et al. | 160/84.04 |

FOREIGN PATENT DOCUMENTS

| | | | | |
|---|---|---|---|---|
| EP | 0163927 | * | 4/1985 | 160/168.1 R X |
| EP | 0889193 | * | 7/1998 | 160/168.1 R X |
| JP | 15776 | * | 1/1996 | 160/168.1 R X |

* cited by examiner

*Primary Examiner*—Bruce A. Lev
(74) *Attorney, Agent, or Firm*—Jeffrey M. Kaden; Gottlieb, Rackman & Reisman, P.C.

(57) ABSTRACT

The invention includes an unbalanced horizontal blind with a spring means to provide a lifting or retraction force for the slats of the blinds. A brake means prevents undesired movement of the slats that would otherwise result from the continuous retraction force of the spring means when the slats are set in a desired position. Controls for the release of the brake means and tilting are also provided in an embodiment of a blind of the invention. An embodiment of the invention permits the blind to be operated by a single wand that can be used to either raise the slats or tilt the slats. This eliminates the need for a loose cord or bead chain that would traditionally be used as the user interface for controlling the movement of the slats of the blind.

33 Claims, 13 Drawing Sheets

SEMI-CORDLESS UNBALANCED SPRING DRIVEN BLIND SYSTEM AND METHODS FOR ADJUSTING AND MAKING SAME

This application claims the priority filing date of U.S. provisional patent applications Ser. Nos. 60/366,502 and 60/366,501 filed on Mar. 20, 2002.

FIELD OF THE INVENTION

The invention relates to the field of window treatments. More specifically, the invention is a system for controlling the lift or lift and tilt of an unbalanced window treatment in the presence of a continuous retraction force.

BACKGROUND OF THE INVENTION

In the construction of horizontal blinds two kinds of controls are usually desired. The blind can have a control to lift the slats of the blind. In addition, the blind may permit control over the tilt of the slats. Cords or tape will generally be attached to or through the slats of the blind and into the head rail of the blind to connect with the control apparatus. To allow a user to operate the blind, an external interface is provided. Traditionally, the interface for lifting includes a cord extending from the head rail of the blind. When separate controls are provided for lift and tilt, typically a wand is utilized to change the tilt of the slats. Depending on the control devices used in the head rail, a cord or bead chain may also be configured to provide the user interface for control over the tilt of the blind without a wand. However, these cord-type interfaces typically hang freely in a loop or as two separated lengths of cord. Recently, consumer advocates have questioned whether cord-type interfaces might potentially pose a safety hazard to children if misused.

BRIEF DESCRIPTIONS OF THE INVENTION

An objective of the invention is to provide a blind that can be operated without a cord or chain user interface.

It is another objective to provide a blind that automatically and securely locks lift cords or slender lengths of flexible lifting material in place to reduce the likelihood of these materials from being pulled from the slats and becoming a possible safety hazard.

It is a further objective to provide such a blind with controls that allow a user to lift and lower the slats of the blind with ease.

It is a further objective to allow the user to have control over the tilt of the slats of the blind.

It is another object to provide such a blind with only a single control device.

A still further objective is to provide such a device that is economical and simple to manufacture.

Additional objectives will be apparent to those skilled in the art upon reading the disclosure of the invention that follows.

Generally, the invention involves an apparatus for the control of a window treatment with a cover that is raised and lowered vertically. The apparatus includes a shaft, a slender length of flexible lifting material and a gathering means coupled to the shaft to receive and wind the lifting material. The window cover is combined with the lifting material to permit the window cover to lift with the movement of the lifting material toward the shaft with the assistance of a spring means that provides a continuous retraction force for lifting the cover and coiling the lifting material by the gathering means. A brake means coupled to the shaft is provided to prevent or release the rotation of the shaft.

In one embodiment the invention is a horizontal blind with controls for the lift and tilt of slats. The blind is provided with a spring means to provide a continuous lifting or retraction force to assist the lift of the blind. The spring means also serve to assist in coiling the lifting material attached to the slats of the blind on a gathering means coupled to a shaft in the head rail. The spring means may be a blade spring or torsion spring. A brake means coupled to the shaft is provided to selectably permit or prevent rotation of the shaft. An optional rotation reducing means or gear box reduces the rotation ratio between the shaft and the spring. Optionally, one end of the spring means may traverse a track in the head rail of the blind to permit expansion and compression of the torsion spring. The spring means preferably includes a drum and a tab so that the spring may easily be loaded with a retraction force during assembly.

In one embodiment, the brake means includes a release arm, a brake spring, and a brake drum. The brake drum is coupled to rotate with the shaft and the release arm is positioned to contact the brake drum to impede rotation of the brake drum. The brake spring and release arm can be configured to maintain the release arm in frictional contact with the brake drum under force of the brake spring. A brake sleeve around the brake drum with a high coefficient of friction impedes rotation of the brake drum when the brake sleeve is interposed on the brake drum and in contact with the release arm.

In one embodiment of the blind where a tilter is provided, the brake means is combined with a tilting control means to operate the tilter to tilt the slats. The control serves as a single user interface with a release position, a brake position and a tilt position for control of movement of the slats. The brake means disengages by a lateral movement of the user interface and the tilting control means adjusts by turning or twisting the user interface. The user interface may be provided as a single wand. The user interface also optionally includes a tactile feedback means, such as a ball bearing and a spring located near grooves of the interface, to assist the user in distinguishing the release position, brake position and tilt position.

A preferred combined control includes a rod and a brake coupling with a fixed coupling portion and rotatable coupling portion. The rotatable coupling portion is mounted to the rod and the fixed coupling portion is mounted with the head rail. A helical gear key mounted on the rod fits within an aperture of a helical gear coupled to the rod and a gear coupled to the main rotational shaft of the blind.

The control permits a novel way for adjusting a window blind to the preference of a user. The rod may be moved in a lateral direction along an imaginary axis running the length of the rod to move slats in a vertical direction. Twisting the rod in a circular direction will tilt the slats. The lateral movement disengages a brake on the shaft in the horizontal window blind and the stored spring force raises the slats. Releasing the rod coupled to the shaft will stop vertical movement of the slats.

A novel method for the assembly of the unbalanced horizontal blind is also disclosed. Generally, the preferred assembly method includes providing the components of a horizontal blind, including a spring means with a drum and tab for winding the spring means. A winding strap of a pre-determined length is also provided. The winding strip being attached to the tab is wrapped around the drum before installation. The components of the horizontal blind with the spring are installed in the head rail but leaving the spring free to rotate. The shaft is rotated to gather the slats to the head rail. Afterward, the spring is partially braked and the winding strap removed, thereby turning the spring, to load a force into the spring. The installation of the spring is then completed by coupling its mount in the head rail to maintain the force loaded into the spring means. The strap may be a pre-determined length calculated to wind the spring an appropriate number of turns to load a force in the spring that will be sufficient or equivalent to the force required to lift the plurality of slats.

DETAILED DESCRIPTION OF THE INVENTION

Figure 2A:
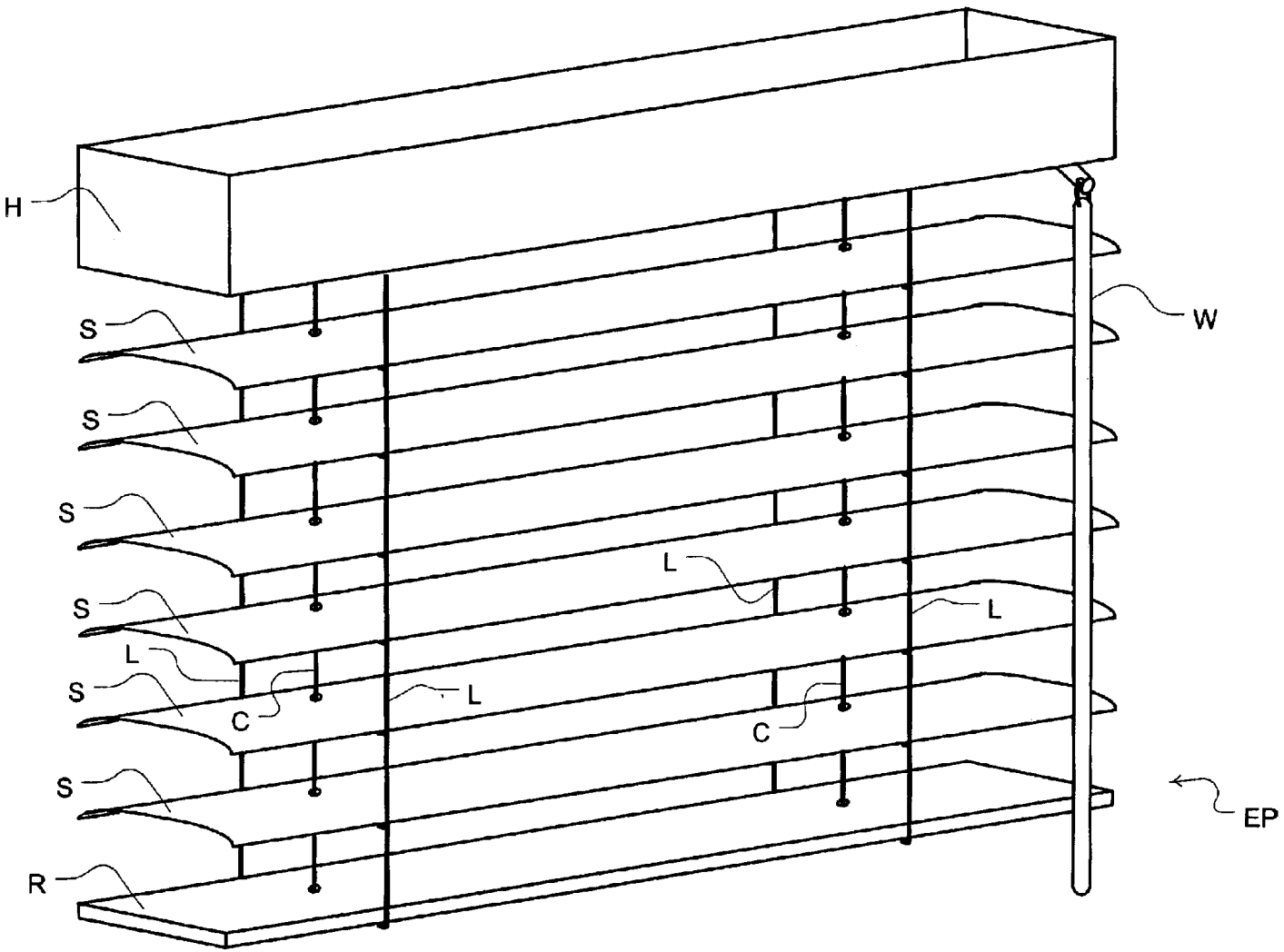
FIG. 2A is a horizontal blind of the invention with slats in an extended position.
Figure 2B:
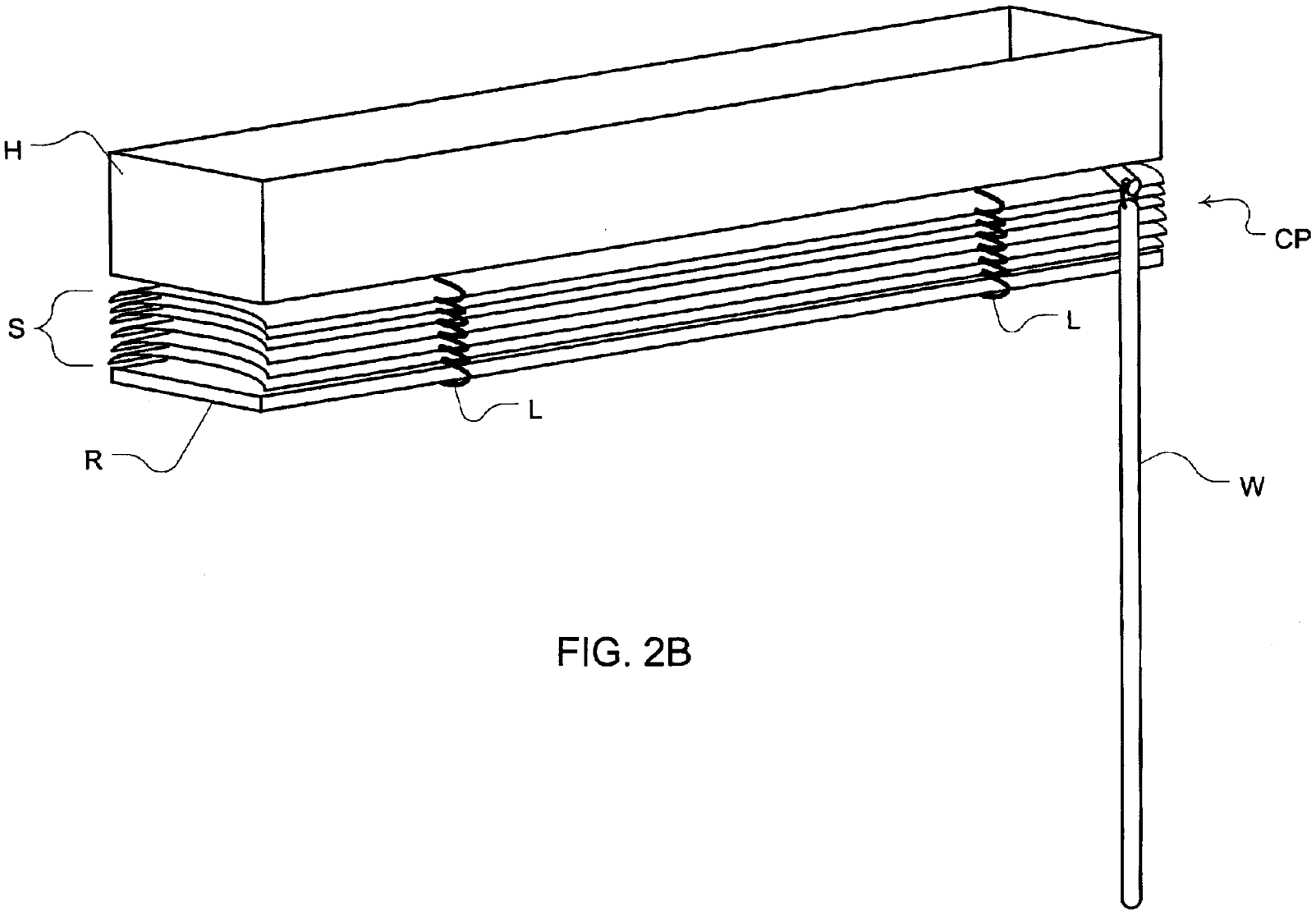
FIG. 2B is a horizontal blind of the invention with slats in the retracted position.

As illustrated in FIGS. 2A and 2B, a horizontal blind B includes a head rail H and slats S. The blind B also utilizes lift material such as lift cord C or ladder material such as a ladder cord L which are integrated with the slats S. The lift cords C permit the slats S to be raised and lowered relative to the head rail H. The ladder cords C provide support for the slats S when the slats S are extended down from the head rail H. The ladder cords C also permit the slats S to be tilted if the front portion of the ladder cord C is raised as the back portion of the ladder cord C is lowered or vice versa. The lifting and tilting of these cords is controlled by the apparatus within the head rail H. Depending on the control apparatus provided, a user interface, shown as a flexible wand W in FIGS. 2A and 2B, may be used to tilt the slats S by twisting the wand W, and/or release the slats S for raising or lowering by pulling the wand. Although the wand W is a preferred user interface, those skilled in the art will recognize that in some applications other structures may be substituted for the wand.

Figure 1:
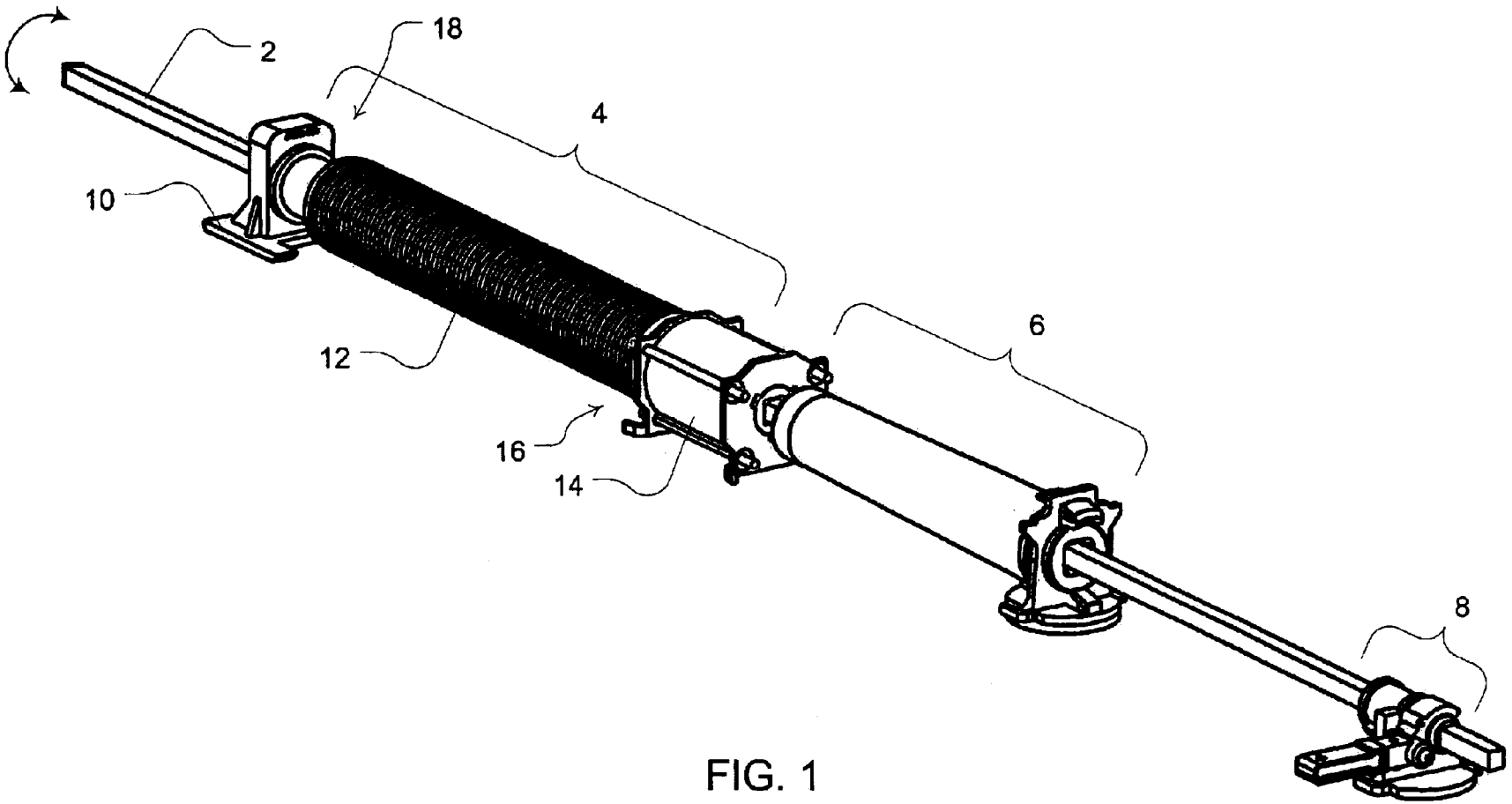
FIG. 1 is a perspective view of some components in a blind of the invention.

FIG. 1 depicts control components of a blind that permits the slats S of the blind to be raised and lowered with ease without requiring the use of a user interface cord. The preferred components of the control apparatus include a rotateable shaft 2, a spring means 4, a gathering means 6 (illustrated as a cord-gathering shaft) and a brake means 8. In this embodiment, the lift cord L from the slats S of a blind will wind onto one or more cord-gathering shafts as the slats are raised. A force stored in the spring means 4 reduces the lift required by a user when the slats are raised. The brake means 8 stops the rotation of the shaft 2 to allow the slats to be lowered or raised to a desired fixed position.

Figure 3:
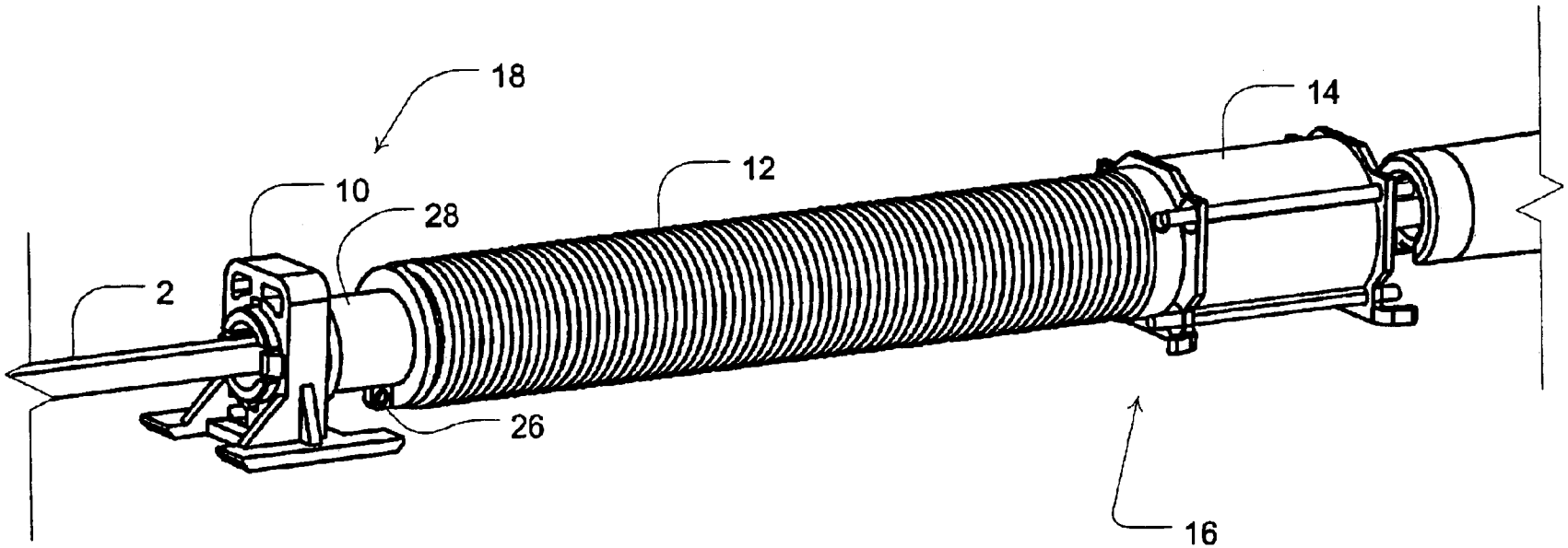
FIG. 3 is an alternative perspective view of some of the components of FIG. 1.
Figure 12:
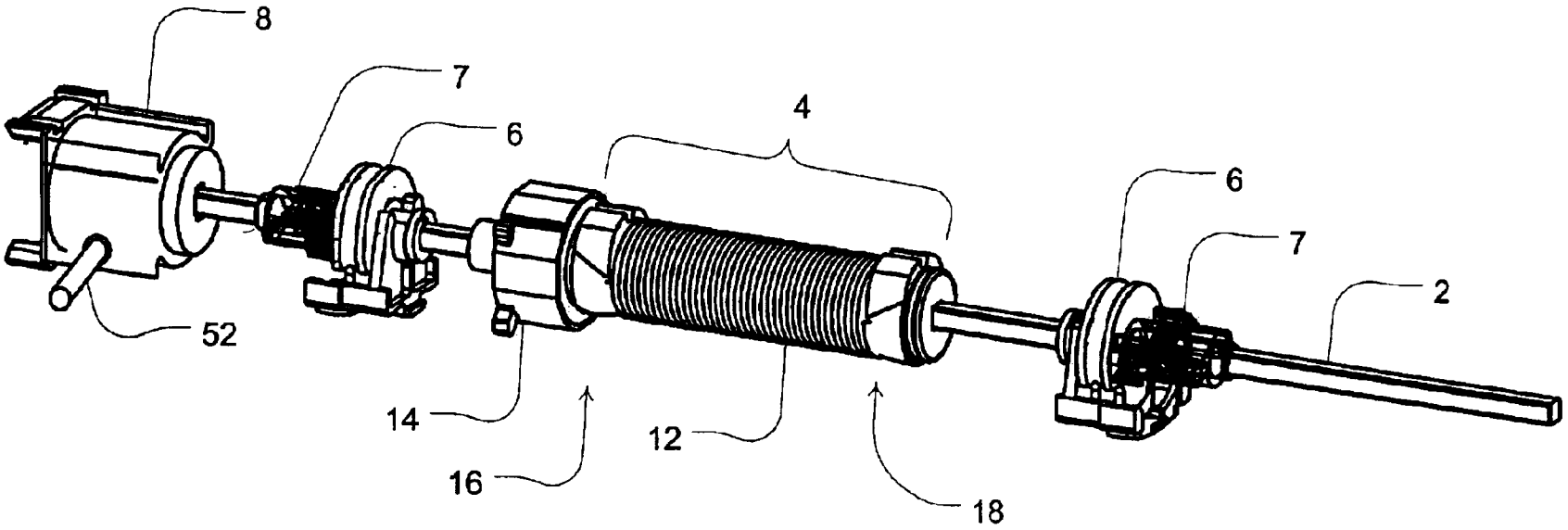
FIG. 12 is a perspective view of an alternative embodiment of components in a blind of the invention.

As illustrated in FIGS. 1, 3 and 12, the preferred spring means includes a torsion spring. The torsion spring will store a rotational force for rotating the shaft 2 to assist with the retraction of the slats S to ensure orderly re-coiling of the lift cord and to ease lifting of the blind. The loaded force will increase as the slats S are moved to their lowest extended position EP (shown in FIG. 2A) and decrease as the slats S are collected and raised into a collected position CP near the head rail HP (shown in FIG. 2B). The torsion spring has a rotation end 16 and a fixed end 18. Generally, the rotation end 16 will rotate in conjunction with the shaft 2 to load or release a force in the spring. The fixed end 16 is connected with the head rail H by a fixed end mount 10 so that it will not rotate with the shaft 2. The fixed end mount 10 may optionally reside in a track (not shown) in the head rail H that will permit the fixed end 16 to move longitudinally, along the shaft and track, in combination with the changing length of the spring as it compresses and decompresses. While allowing the transverse movement, the track still prevents the fixed end 16 from rotating with the shaft.

Figure 4:
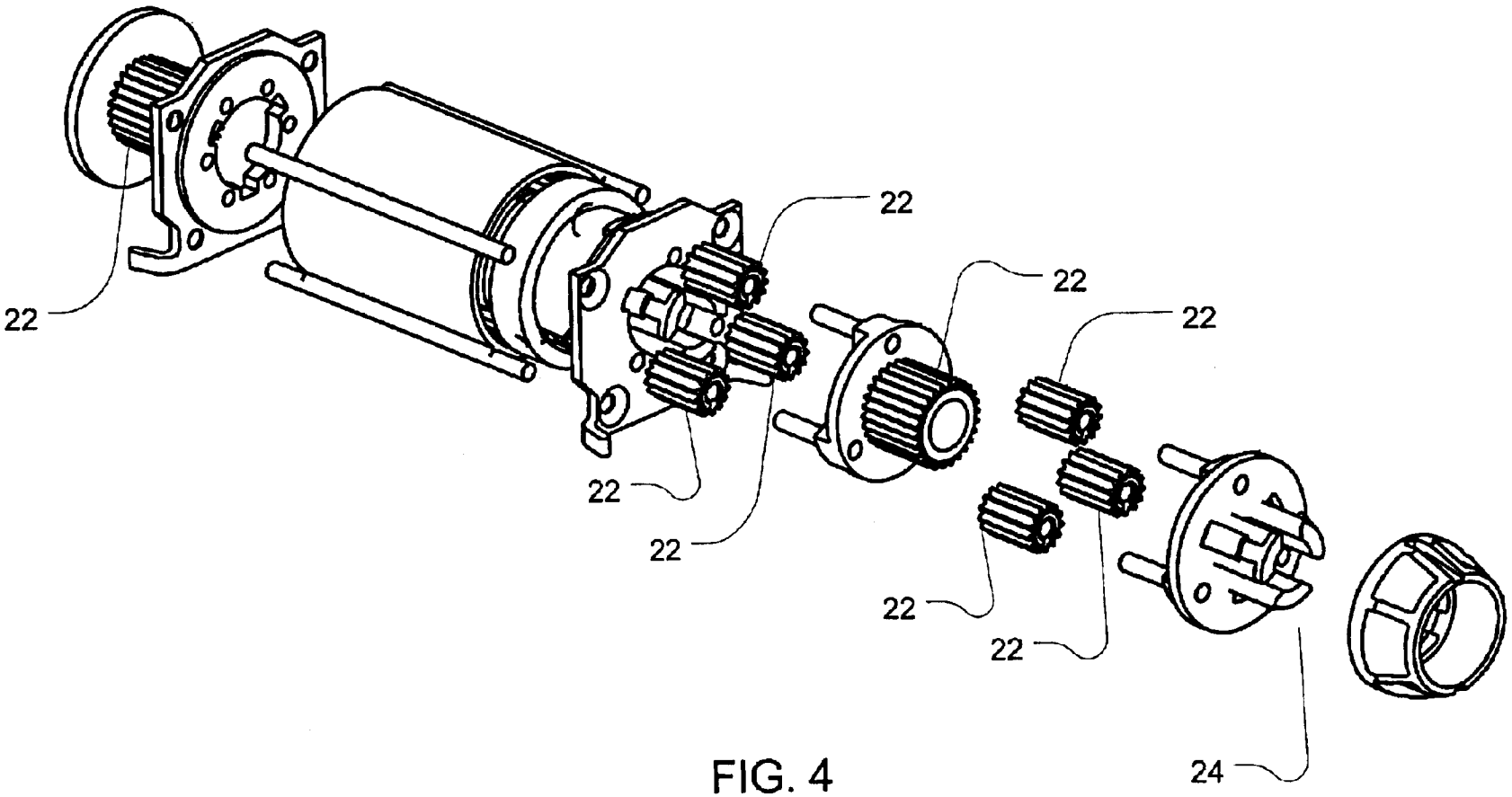
FIG. 4 is a perspective view of the components of a gear box from a geared torsion spring of the invention.
Figure 5:
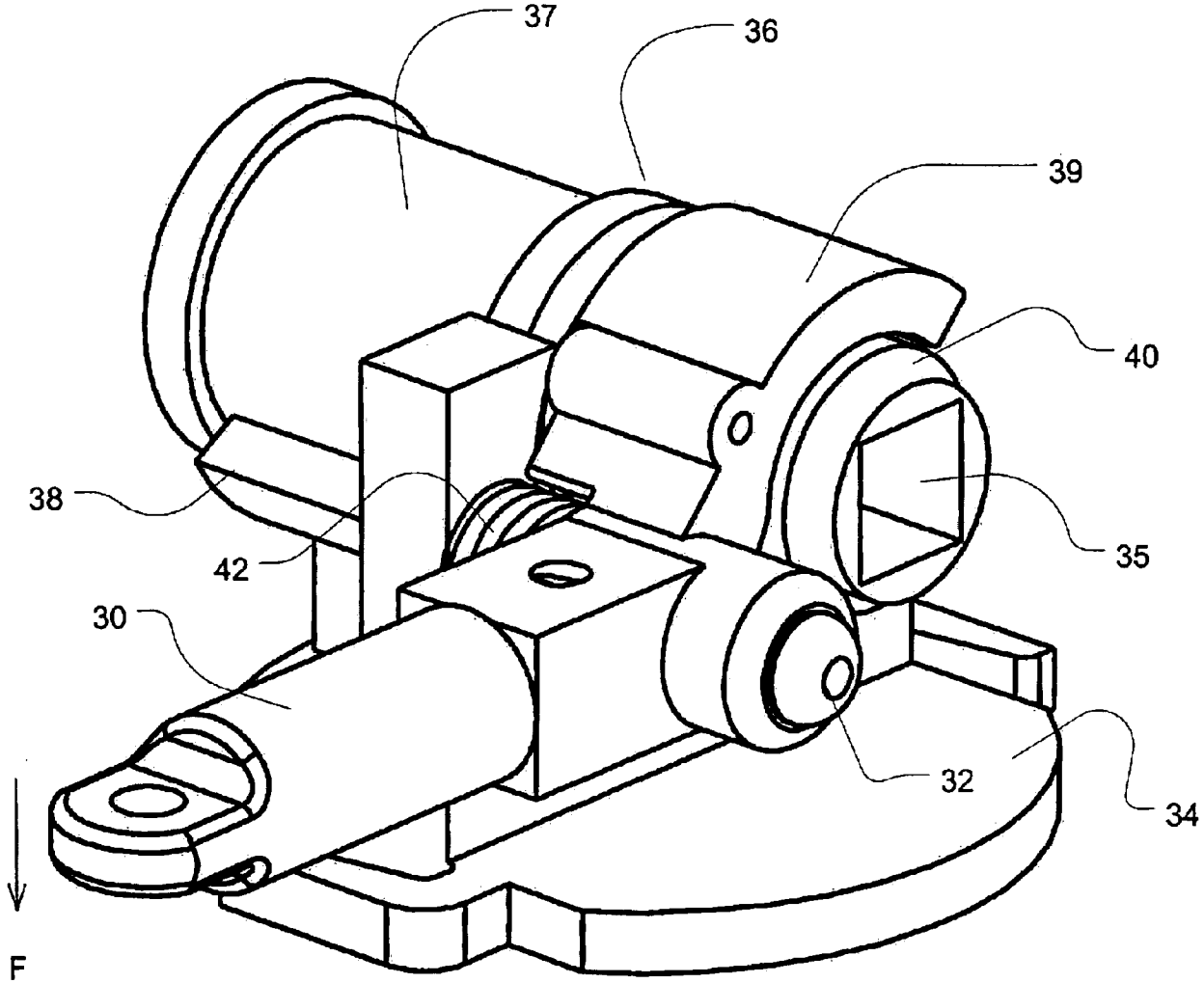
FIG. 5 is a perspective view of a brake of the invention.
Figure 6:
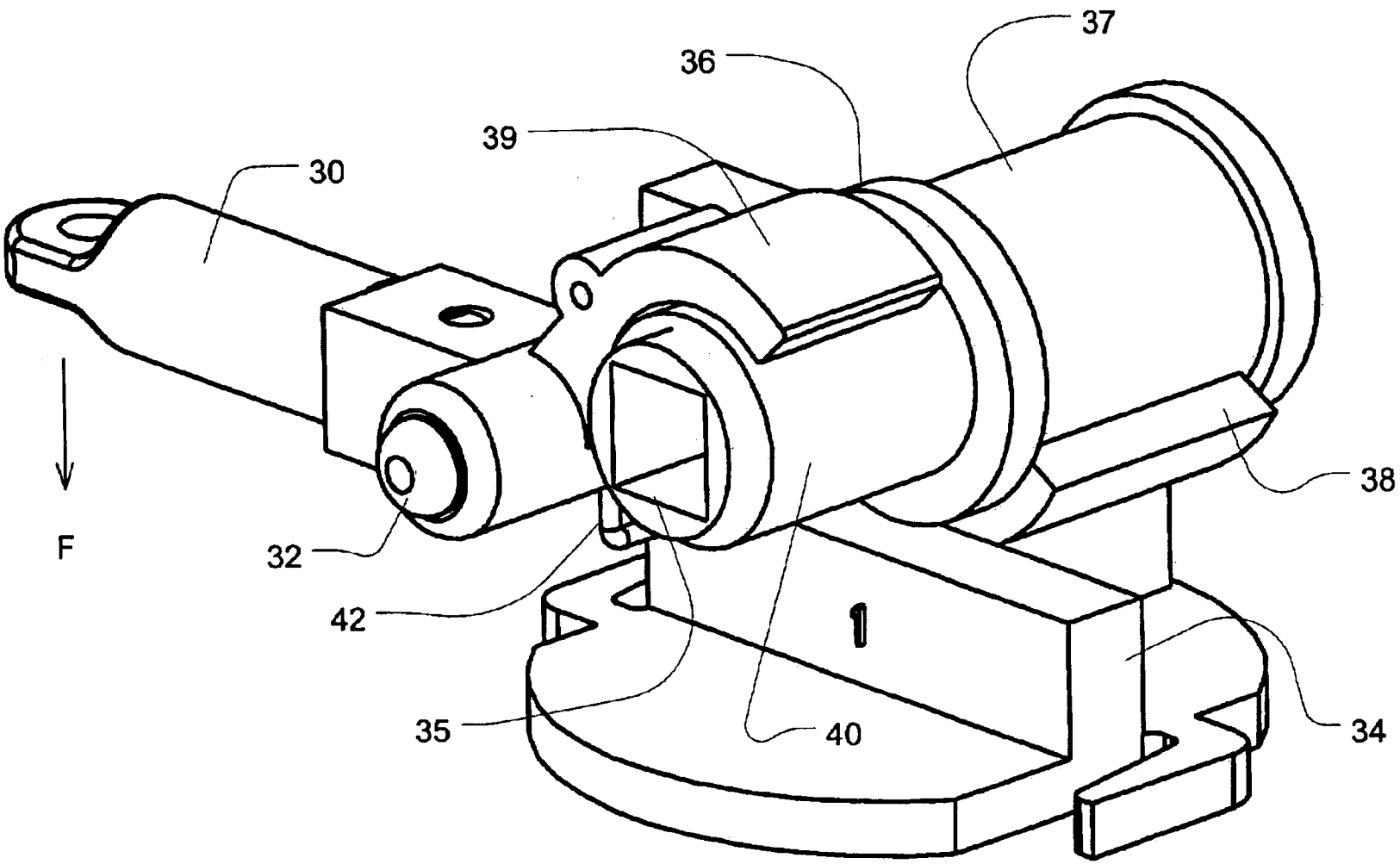
FIG. 6 is another perspective view of the brake of FIG. 5.
Figure 7:
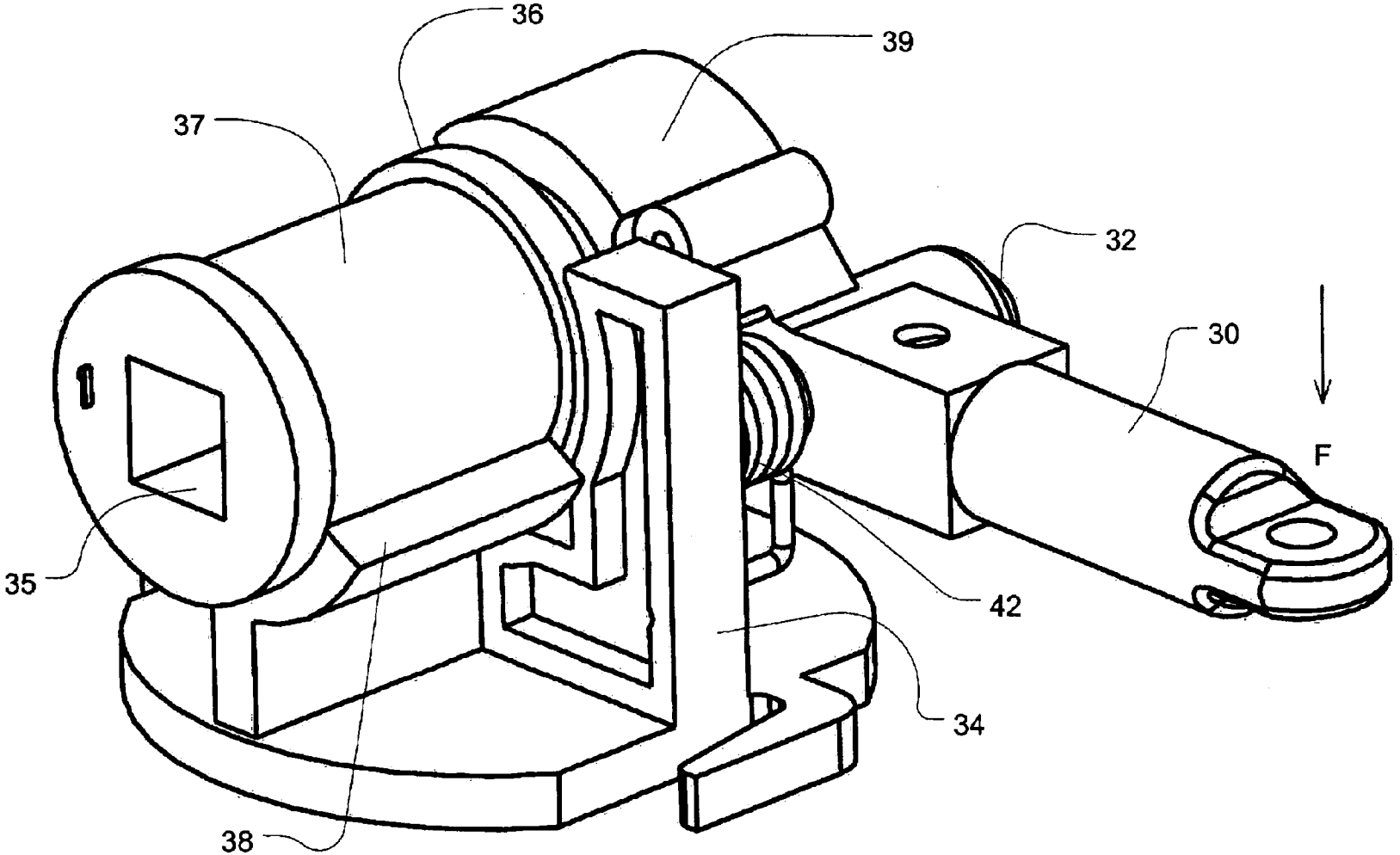
FIG. 7 is another perspective view of the brake of FIG. 5.
Figure 8:
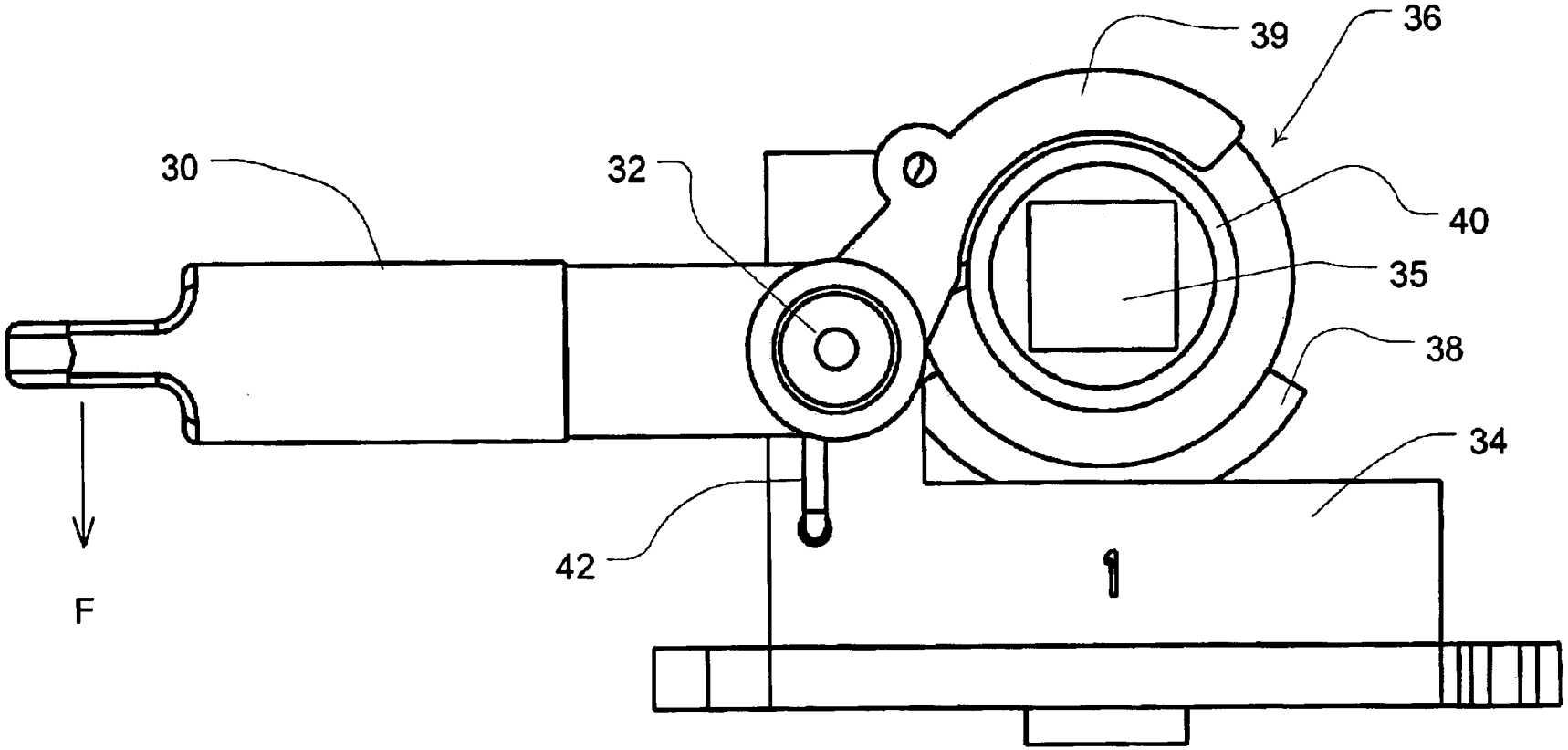
FIG. 8 is a side plan view of the brake of FIG. 5.
Figure 9:
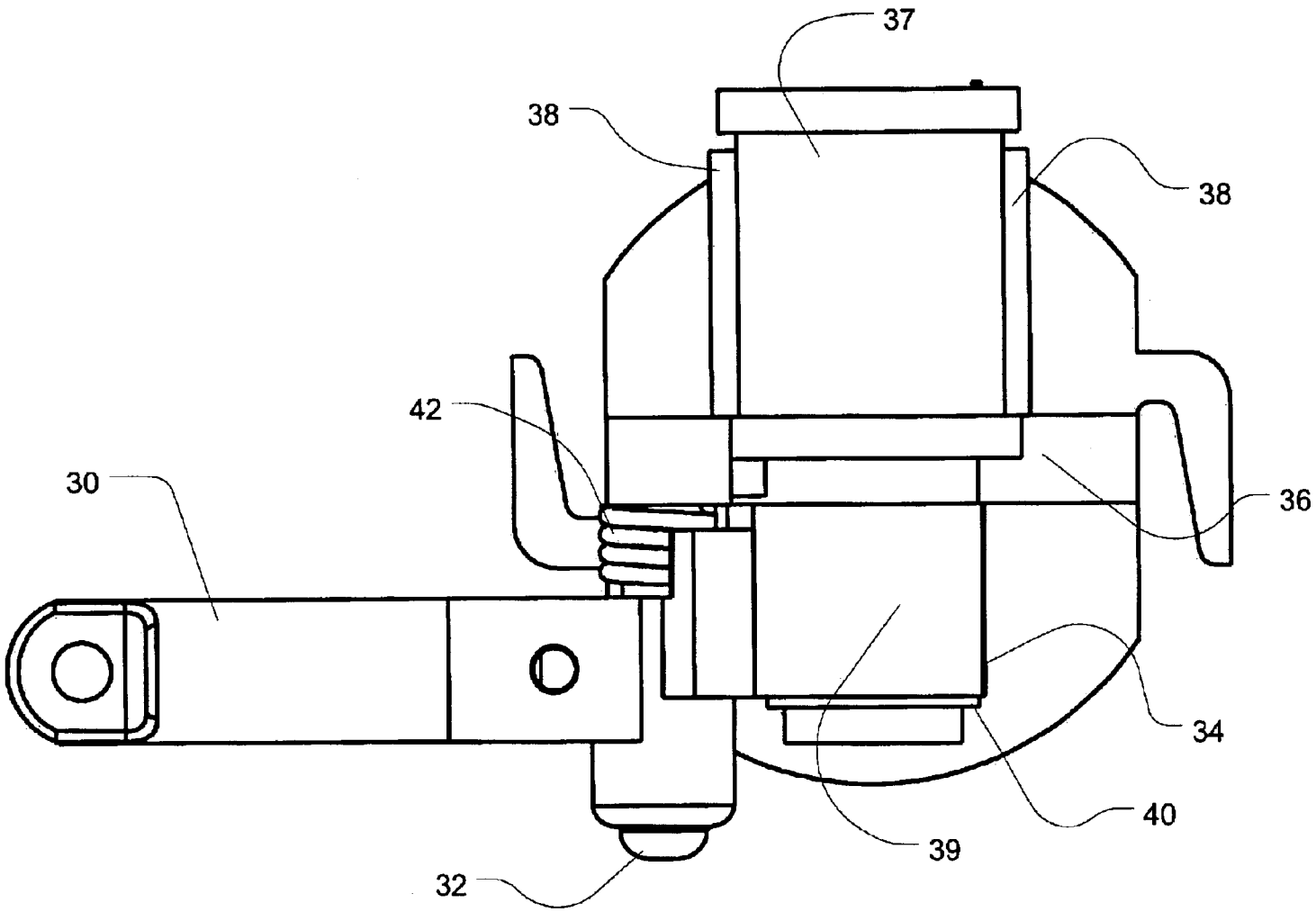
FIG. 9 is a top plan view of the brake of the brake of FIG. 5.
Figure 10:
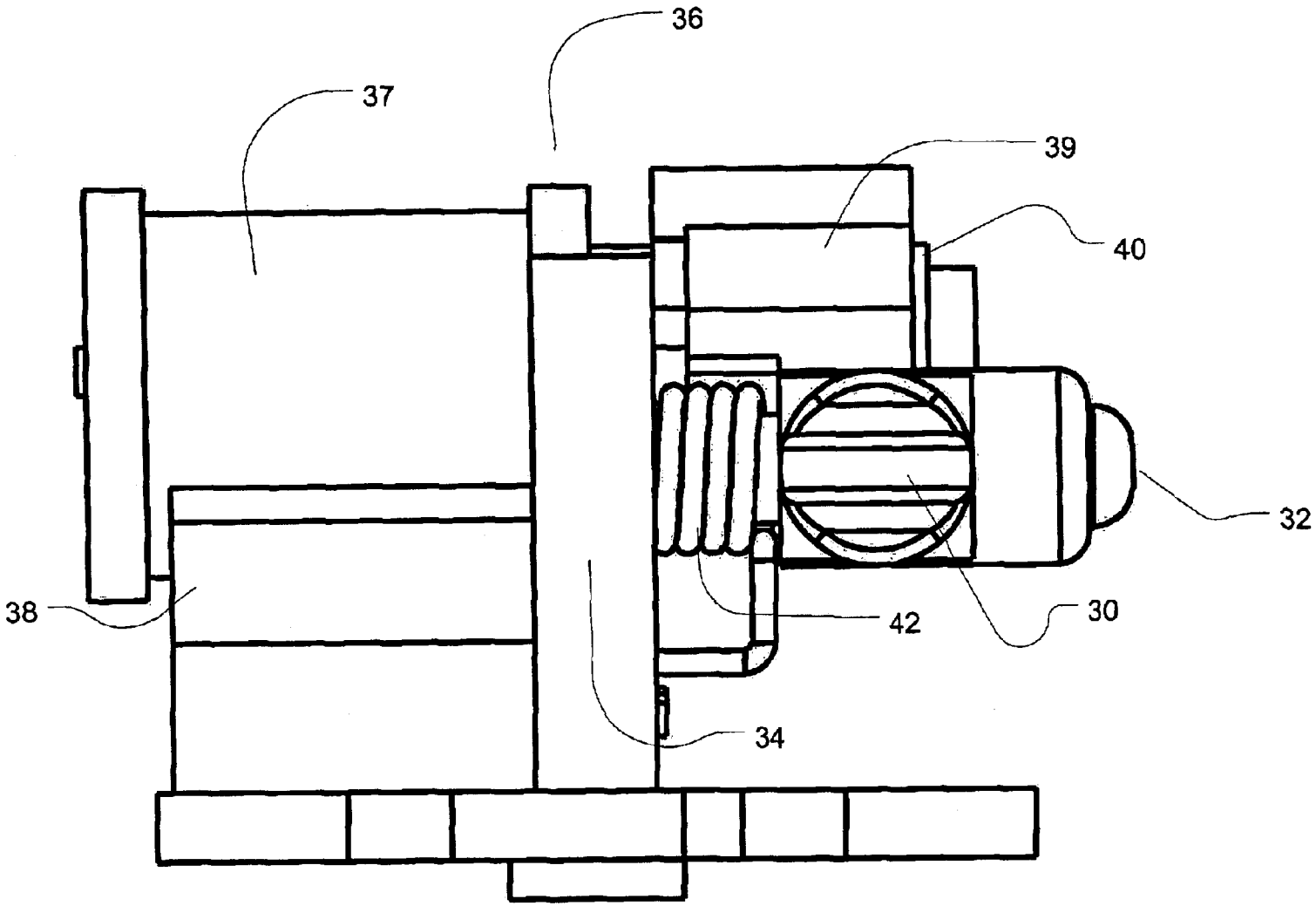
FIG. 10 is a front plan view of the brake of FIG. 5.

In this embodiment, the rotation end 18 is preferably engaged or coupled to a rotation reducing means 14. This rotation reducing means 14 is coupled to the head rail. The rotation reducing means 14 changes the turn ratio between the shaft 2 and the torsion spring 12. A single complete rotation of the shaft 2 will result in less than one complete rotation of the rotation end 16 of the torsion spring 12. The rotation reducing means is shown in FIG. 4 as a gear box. The gear box includes gears 22 and a spring adapter 24. By implementing a turning ratio reduction (shaft to spring), the torsion spring is less likely to be over wound in conjunction with the rotation of the shaft 2 as the slats S are lowered. In other words, it permits the loading of a smaller force in the torsion spring when compared to the force that would otherwise be loaded if the torsion spring turned by the same ratio as the shaft 2.

This reduced force is also beneficial when considering that a smaller force is required to lift or retract the slats when the slats are in the extended position EP when compared to the force required to lift the slats when they are retracted near the collected position CP. This difference is the result of the fact that the slats will be supported by the ladder cord L when they are in the extended position EP but not when they are in the collected position CP. When the slats are in the collected position CP the slats are generally supported by the lift cord C. As the bottom rail R of the blind raises, each collected slat will change from being supported by the ladder cord L to being supported by the lift cord C.

The torsion spring may optionally be provided with a winding tab 26 proximate to a pre-loading drum 28. While the winding tab 26 and pre-loading drum 28 will rotate with the torsion spring, they have no particular function during the ordinary use of the blind. However, these structures serve to simplify the assembly of the components into a head rail H. The function of these features is described in more detail in a discussion of the assembly and use of a blind that follows herein.

As a result of the functioning of the spring means and the tendency of the slats S to return to the collected position CP after being moved to an extended position EP, the blind is unbalanced. To compensate for the unbalanced nature of the blind, a brake means 8 is provided. The brake means prevents the force stored in the spring means from retracting the slats S until retraction is desired. The brake means also impedes or prevents the lift cord or slender lifting material from being pulled from the gathering means on the shaft unless the brake means is disengaged.

The details of a preferred embodiment of the brake means 8 are illustrated in FIGS. 5–10. The preferred brake means 8 is a spring activated disk-type brake. In this brake a release arm 30 pivots on a pin 32 integrated to a brake housing 34. A disk drum 36 is keyed to rotate with the shaft 2 which passes through a shaft aperture 35 in the drum. The disk drum 36 is configured with a smooth portion 37 to rotate within a support 38 of the brake housing 34. A brake sleeve 40 with a high coefficient of friction is coupled around the disk drum 36 proximate to the release arm 30. A brake spring 42 forces the release arm 30 to contact the brake sleeve 40 to frictionally impede rotation of the brake sleeve 40 and thereby impede rotation of the shaft 2 through the disk drum 36. When a downward force F is applied to the release arm 30, the release arm 30 pivots contact portion 39 away from contact with the brake sleeve 40, thereby permitting the brake sleeve 40 and shaft 2 to rotate. The downward force F increases the load of the brake spring 42 which in turn causes the release arm 30 to return to its position against brake sleeve 40 when the downward force ceases. A wand W may be coupled to the release arm 30 as illustrated in FIGS. 2A and 2B to permit a user to operate the brake.

Although the embodiment of FIG. 1 depicts only components associated with the control of the lifting and lowering of the slats S, tilting devices 7 or tilters can be added to the shaft as illustrated in the embodiment of FIG. 12 to permit control over the tilting of the slats S. Such tilting devices are known in the art. One such tilting device is the subject of commonly owned non-provisional U.S. patent application Ser. No. 10/389,837 entitled "Mono Control Lift and Tilt Mechanism for Horizontal Blinds" filed on Mar. 17, 2003, which claims priority to U.S. provisional patent application Ser. No. 60/367,308 filed on Mar. 25, 2002. This application also discloses a gathering means 6. The disclosure of the foregoing non-provisional application is hereby incorporated by reference. Alternative tilters are disclosed in the patent to Rude et al., U.S. Pat. No. 5,228,491 and the patent to Rude, U.S. Pat. No. 4,697,630. The disclosure of the foregoing U.S. patent specifications is incorporated herein by reference.

Figure 11C:
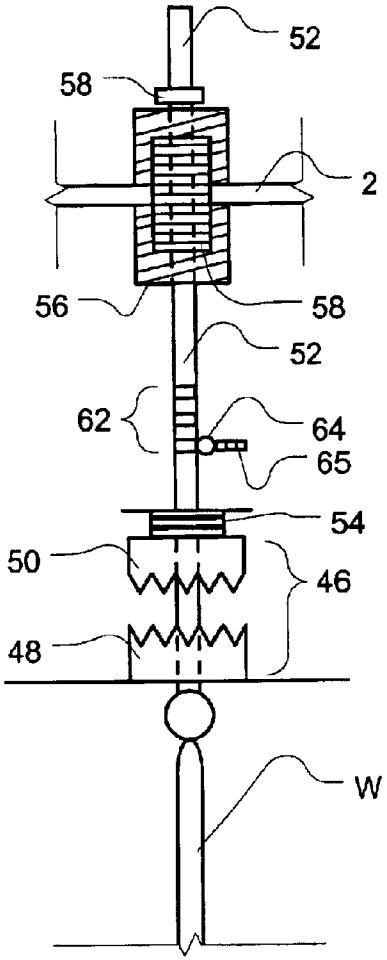
FIG. 11C is a plan view of an alternative brake and tilter control of FIG. 11A in a fully released position.
Figure 11B:
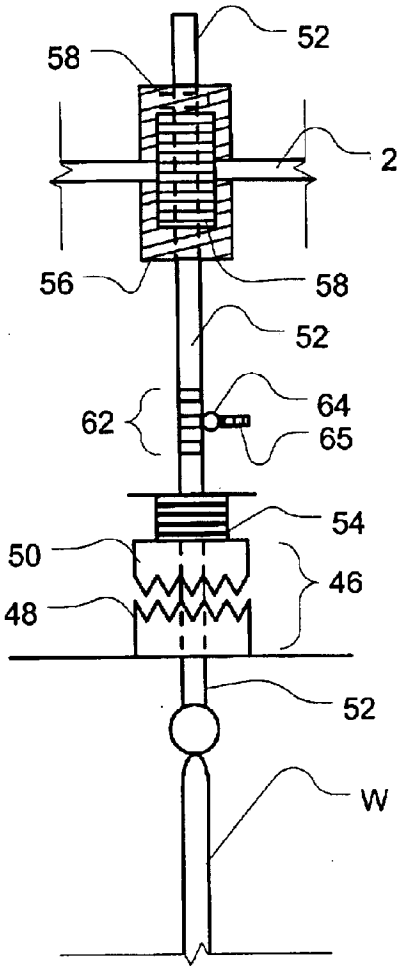
FIG. 11B is a plan view of the alternative brake and tilter control of FIG. 11A in a tilt control position.
Figure 11A:
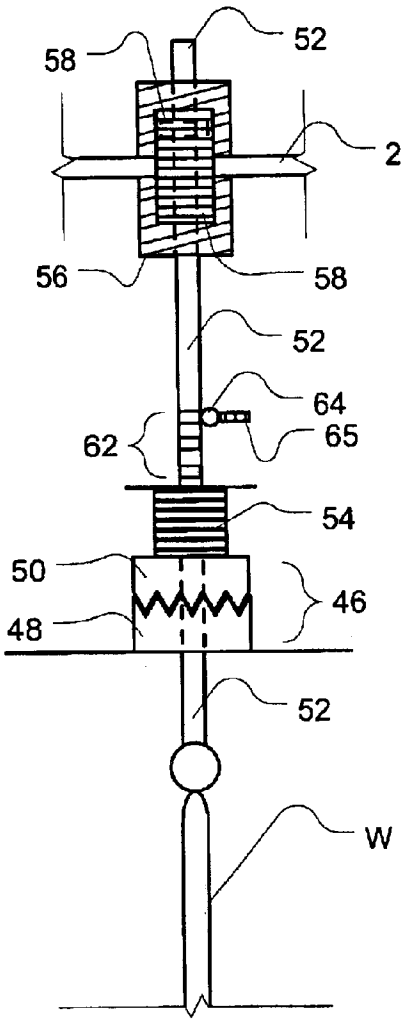
FIG. 11A is a plan view of an alternative brake and tilter control for a blind of the invention in a braked position.

In a blind of the invention where both tilting and lifting are controlled, the interface of the tilter control may be combined with interface for the brake means to provide a common control interface. With such an interface, a user can operate the vertical movement or lift of the slats as well as the tilt of the slats with a single control. In the preferred embodiment of this control both the tilting and braking functions are operated with a single wand W. The combination of these controls including a brake means is depicted in FIGS. 11A, 11B and 11C. The preferred embodiment of the control includes a brake coupling 46 with a fixed coupling portion 48 and a rotatable coupling portion 50. The fixed coupling portion 48 is fixed with or to the housing. The rotatable coupling portion 50 is attached to rod 52 and will be rotated with the rotation of the rod 52. The rod 52 passes and may move through the fixed coupling portion 48. Of course, a wand W may be coupled to the rod 52 to allow a user to reach the control when the blind is installed in higher window applications.

The coupling portions 50, 52, are provided with complementary jagged surfaces such that when the fixed coupling portion 48 is seated with the rotatable coupling portion 50 rotation of the brake coupling 46 is prevented. A coupling spring 54 is mounted, for exmple, to the head rail H and the rotatable coupling portion 50 to provide a seating force that will serve to return the rotatable coupling portion to its seated engagement with the fixed coupling portion 48 after disengagement. When the couplings are engaged, the control is in a braked position as shown in FIG. 11A.

As illustrated in FIG. 11A, the rod 52 extends to the shaft 2 of the blind. The rod 52 has a helical gear 56 positioned near a shaft gear 58. The shaft gear 58 is fixed to the shaft 2. As a consequence, the shaft 2, the shaft gear 58 and the helical gear 56 will each move in conjunction with the movement of each other. However, the helical gear 56 and rod 52 are configured such that the helical gear 56 will rotate with the rod 52 depending on the positioning of the rod 52. The rod 52 may be disengaged from the helical gear 56 such that the helical gear 56 may turn without the rod 52. In the embodiment shown in FIGS. 11A, 11B and 11C, the rod 52 can move laterally along an imaginary axis extending the length of the rod 52 through a channel within the helical gear 56. A rod pin 60 fixed to the rod 52 serves as a helical gear key to engage or disengage with a complementary groove in the helical gear 56 depending on the position of the rod 52 within the channel through the helical gear 56. When the rod pin 60 is engaged with the helical gear 56, the rod 52 and helical gear 56 will rotate together. When the rod pin 60 is disengaged from the helical gear 56, the helical gear 56 can rotate independently from the rod 52 and vice versa. A helical gear mount (not shown) holds the helical gear in position relative to the lateral movement of the rod 52 while allowing the helical gear to turn in conjunction with the shaft 2 and shaft gear 58.

The length of the rod 52, the configuration and depth of the groove of the helical gear 56 and the positioning of the components are coordinated to provide different control responses depending on the positioning of the rod 52. Optionally, grooves 62 in the rod 52 in conjunction with a ball bearing 64 serve as a tactile feedback means to provide tactile feedback to the user to identify the different control positions when using the wand or rod as the ball bearing snaps into a groove with the assistance of a bearing spring 65 pressing against the ball bearing 64. These aspects of the invention are illustrated by the different positions of the rod 52 in FIGS. 11A, 11B, and 11C.

In FIG. 11A, the rod 52 is positioned to serve as a brake. In this brake position, the brake coupling is seated which in turn will prevent rotation of the rod 52. Since in this position the rod pin 60 is engaged with the helical gear 56, the shaft 2 will not turn and the slats S will be prevented from raising or lowering despite the exertion of a rotational force on the shaft 2 resulting from the spring means 4.

As illustrated in FIG. 11B, the rod 52 is positioned for tilting. The rod 52 is moved laterally to disengage the brake coupling 46. However, since the rod pin 60 is still engaged with the helical gear 56, twirling the rod 52 or wand W will result in the turning of the shaft 52. An appropriate tilting device 7 (shown in FIG. 12) installed on the shaft 52 will then permit the slats S to tilt with the rotation of the shaft 52. This position will also permit a user to raise or lower the slats S of the blind manually by continuing to twist the rod 52 or wand W if desired.

The positioning of the rod 52 shown in FIG. 11C permits the shaft 2 to rotate freely, independent of the rod 52. In this released position, the rod pin 60 of the rod 56 extends beyond the groove of the helical gear 58 allowing the helical gear 58 to rotate without the rod 52. In this position, the slats S of the blind may be raised and lowered without rotation of the wand W.

Those skilled in the art will recognize that this multi-position, multi-control device can be constructed to disengage the brake means by pull rather than push. Optionally, the control components may be provided in a combined structure within a separate housing (as illustrated in FIG. 12) to simplify installation during assembly of the blind structure.

In regard to the use and assembly of the unbalance blind as disclosed herein, it has been determined that a most advantageous performance of the unbalanced blind can be achieved if the spring means 4 is assembled and the spring is loaded with a stored force. This stored force preferably exists with all of the slats retracted near the head rail in their collected position CP as illustrated in FIG. 2B. In this sense, the force is continuous regardless of the position of the slats. A preferred force is approximately equivalent to the force needed to maintain the stats in the raised or collected position CP, however, a lesser force may be pre-applied to the torsion spring. The selection of a desired force must be balanced against the nature of the effort that will be exerted by a user in raising or lowering the slats. A higher force will require no user effort to raise the slats. A lower force will require some effort.

To permit the loading of a desired force into the spring means during assembly of the blind, before installation, a winding means (not shown) is attached to the winding tab 26 wound around the pre-loading drum 28. The winding means may be for example, a pre-determined length of string or other flexible strip or winding strip. The blind is then assembled by installing its components into the head rail including the spring means 4, gathering means 6, shaft 2 and any optional tilting device. The slats S and bottom rail R are also combined in the extended position EP with the lift and ladder cord or lift and ladder tape depending on the gathering means 6 and tilter devices chosen. However, when the spring means 4 is installed, its fixed end 18 is not engaged to the fixed end mount 10. Optionally, the rotational end 16 may also be disengaged from the rotation reducing means 14. This prevents any undesired load from accumulating in the spring means 4 if the shaft 2 is rotated during assembly. With the spring means disengaged, the lift cord or lift tape is gathered into the head rail by rotating the shaft 2 until the bottom rail R and slats S are in the collected position CP.

Once the slats S are in the collected position CP, the rotation end 16 of the spring means 4 is coupled to the rotation reducing means 14, if not previously done during the original install of the spring means 4. The shaft 2 is then held stationary by the brake means 8 while the winding means is pulled from the pre-loading drum 28. This will result in the rotation of the spring means 4 a certain number of turns that is equivalent to the pre-determined length of the winding means. The spring means 4 is then coupled to the fixed end mount 10 at its fixed end 18 without releasing the spring means 4 to maintain the stored force in the completed assembly. The winding means may then be removed or cut from the winding tab 26. Those skilled in the art will recognize that by changing the length of the winding means, different loads may be pre-set into the spring means 4 to supply the correct force needed to accommodate the particular weight and number of the slats S that will be used for the particular application of the blind. The method is the same for a window covering without slats such as a shade, with the exception that the covering is gathered to the head rail because of the absence of the slats.

With the stored force in the blind and installed for use in a window, a user can simply operate the shade by pulling (or pushing) the wand W to release the brake means 8. The bottom rail R can then be manually pulled down to lower the blind to any intermediate position or to the extended position EP with little effort. When the wand W is released the brake means 8 will engage and the blind will remain in the selected position. The blind can be easily raised to the collected position CP with the assistance of the spring means 4 by again releasing the brake means 8 by operation of the wand W.

Depending on which tilter device is installed into the head rail, the bottom rail R may be manually tilted to tilt the slats S when the brake means 8 is released. Alternatively, a traditional wand independent from the brake means 8 may be provided to tilt the slats S. In the embodiment with the mono control tilt brake of FIGS. 11A, 11B and 11C, the wand W may be pushed to the tilt position shown in FIG. 11B and then turned or twisted to tilt the slats.

While the invention has been described with regard to various embodiments, it is to be understood that the features are merely illustrative of the principles of the invention. Those skilled in the art would understand that other variations can be made without departing with the spirit and scope of the invention as defined by the claims. For example, rather than utilizing a torsion spring a power spring may be configured to provide the desired lift or retraction force for the slats of the blind. An example of a power spring would include a blade spring having a roll of flat elongated material with one end moving with the shaft and one end fixed relative to the head rail. Those skilled in the art will also recognize, for example, that only some of the components may be utilized to provide a blind with lift control but without tilt control. Similarly, while cords are used in the preferred embodiment, it is understood that such a cord is a slender length of flexible material usable for winding or gathering or supporting the slats. Another such slender flexible material includes, for example, a lift tape or lift material that may be wound on a tape spool. Tape may be configured to form a tape ladder or ladder material. One use of tape as a substitute for a cord is illustrated in FIG. 12 by use of a tape spool in the lifting of the slats S. Moreover, those skilled in the art will recognize that the control system can be used to raise or lower other window treatments or covers where the cover or treatment is lifted vertically by lift cords or a slender lifting material, including, for example, shades such as cellular shades, roman shades or pleated shades.

What is claimed is:

1. A horizontal window blind comprising:

a head rail;

a shaft disposed in the head rail;

a length of flexible lifting material;

a length of flexible ladder material;

a plurality of slats combined with the lifting material and the ladder material to permit the slats to lift with the movement of the lifting material;

a gathering member coupled to the shaft to receive and wind the lifting material;

a spring coupled to the shaft and head rail to provide a continuous retraction force for lifting slats and coiling the lifting material by the gathering member;

a brake coupled to the shaft and having a first position in which the brake prevents the rotation of the shaft and a second position in which the brake permits the rotation of the shaft; and a control member operated by a user to selectively set said brake to one of said first and second positions.

2. The blind of claim 1 wherein the spring comprises a blade spring.

3. The blind of claim 1 wherein the spring comprises a torsion spring.

4. The blind of claim 3 wherein the spring further comprises a spring mount fixed to the spring and mounted on the head rail.

5. The blind of claim 3 wherein the spring further comprises a drum and a tab both coupled to rotate with the spring-for receiving a winding strip to pre-load the spring.

6. The blind of claim 1 wherein the spring further comprises a rotation reducing member coupled between the shaft and spring.

7.The blind of claim 6 wherein the rotation reducing member comprises a set of gears to reduce the ratio of the rotations of the shaft to rotation of the torsion spring.

8. The blind of claim 1 wherein the brake comprises a release arm, a brake spring, and a brake drum, and wherein the brake drum is coupled to rotate with the shaft and wherein in the first position the release arm is positioned to contact the brake drum to impede rotation of the brake drum.

9. The blind of claim 8 wherein the brake spring and release arm are configured in the first position to maintain the release arm in frictional contact with the brake drum under force of the brake spring.

10. The blind of claim 9 wherein the brake further comprises a brake sleeve around the brake drum, the brake sleeve having a coefficient of friction to impede rotation of the brake drum when the brake sleeve is interposed on the brake drum and in contact with the release arm.

11. The blind of claim 1 further comprising a tilter couple to the shaft and the ladder material, wherein the brake further comprises a tilting control to operate the tilter to tilt the slats.

12. The blind of claim 11 wherein the brake and tilting control comprise a single user interface with a release position, a brake position and a tilt position for control of movement of the slats.

13. The blind of claim 12 wherein the brake disengages by lateral movement of the user interface and the tilting control adjusts by turning the user interface.

14. The blind of claim 13 wherein the single user interface is a wand.

15. The blind of claim 14 wherein the user interface is a tactile feedback to distinguish the release position, brake position and tilt position.

16. The blind of claim 11 wherein the brake and tilting control comprise:

a rod;

a brake coupling with a fixed coupling portion and rotatable coupling portion, wherein the rotatable coupling portion is mounted to the rod and the fixed coupling portion is mounted with the head rail;

a helical gear key mounted on the rod;

a helical gear coupled to the rod with an aperture to receive the helical gear key; and a gear coupled to the shaft and mounted with the helical gear.

17. The blind of claim 16 wherein the rod, helical gear key, helical gear and brake coupling are disposed to provide a release position, a brake position and a tilt position for control of movement of the slats.

18. The blind of claim 1 wherein said spring is preloaded to bias said shaft toward a configuration wherein said slats are lifted adjacent to said headrail.

19. A horizontal window blind comprising:

a head rail;

a shaft extending through the head rail;

a plurality of slats with a lifting material;

a gathering member coupled to the shaft to receive and wind the lifting material;

a gear box engaged to the shaft;

a torsion spring with one end engaged to the gear box and the opposing end engaged to the head rail to provide a continuous lifting force to lift the slats and coil the lifting material on the gathering member, the gear box being arranged to reduce the rotation ratio between the shaft and the torsion spring;

a releasable brake with a brake arm and drum on the shaft cooperating to define a first position in which the brake prevents the rotation of the shaft by pivoting the brake arm against the brake.

20. The blind of claim 19 wherein said torsion spring is preloaded to bias said shaft toward a configuration wherein said slats are gathered adjacent to said headrail.

21. A method for the assembly of an unbalanced horizontal blind or window treatment to have a continuous retraction force comprising the steps of:

providing the components of a window treatment, the components comprising (a) a spring with a drum and tab for winding, (b) a plurality of stats or a cover, (c) a flexible lifting material, and (d) a head rail;

providing a winding strap of a pre-determined length;

attaching the winding strip to the tab;

winding the winding strap onto the drum;

assembling the components of the window treatment with the spring disposed in the head rail such that the spring can rotate;

winding the flexible lifting material to gather the cover or slats to the head rail;

securing one side of the spring while unwinding the winding strip to preload a force into the spring; and coupling the spring to the head rail to maintain the force loaded into the spring.

22. The method of claim 21 wherein the components further comprise a brake, a shaft and a ladder material.

23. The method of claim 21 wherein the pre-determined length is calculated to wind the spring by a number of turns to preload a force in the spring equivalent to the force required to lift the plurality of slats or cover.

24. A window treatment system comprising:

a shaft;

a length of flexible lifting material;

a gathering member coupled to the shaft to receive and wind the lifting material;

a window cover combined with the lifting material to permit the window cover to lift with the movement of the lifting material toward the shaft;

a spring coupled to the shaft and being pre-loaded to provide a continuous retraction force for lifting the cover and coiling the lifting material by the gathering member; and a brake coupled to the shaft to selectably permit or prevent rotation of the shaft.

25. The system of claim 24 wherein the spring comprises a torsion spring.

26. The system of claim 25 wherein the spring further comprises a rotation reducing transmission coupled between the shaft and torsion spring.

27. The system of claim 26 wherein the rotation reducing transmission comprises a set of gears to reduce the ratio of the rotations of the shaft to rotation of the torsion spring.

28. The system of claim 25 wherein the spring further comprises a spring mount fixed to the torsion spring for coupling to a track in a head rail to permit the mount to traverse the track with the expansion and compression of the torsion spring.

29. The system of claim 25 wherein the spring further comprises a drum and a tab both coupled to rotate with the spring for receiving a winding strip to pre-load the spring means.

30. The system of claim 24 wherein the brake comprises a release arm, a brake spring, and a brake drum, and wherein the brake drum is coupled to rotate with the shaft and wherein the release arm is positioned to contact the brake drum to impede rotation of the brake drum.

31. The system of claim 30 wherein the brake spring and release arm are configured to maintain the release arm in frictional contact with the brake drum under force of the brake spring.

32. The system of claim 31 wherein the brake further comprises a brake sleeve around the brake drum, the brake sleeve having a coefficient of friction to impede rotation of the brake drum when the brake sleeve is interposed on the brake drum and in contact with the release arm.

33. A horizontal window blind comprising:

a head rail;

a shaft disposed in the head rail;

a length of flexible lifting material;

a length of flexible ladder material;

a plurality of slats combined with the lifting material and the ladder material to permit the slats to lift with the movement of the lifting material;

a gathering means coupled to the shaft to receive and wind the lifting material;

a spring means coupled to the shaft and head rail to provide a continuous retraction force for lifting slats and coiling the lifting material by the gathering means;

a tilter coupled to the shaft and the ladder material;

a tilting control to operate the tilter to tilt the slats; and a brake coupled to the shaft to selectably permit or prevent rotation of the shaft.

* * * * *